US007766543B2

(12) United States Patent
Kato et al.

(10) Patent No.: US 7,766,543 B2
(45) Date of Patent: Aug. 3, 2010

(54) METHOD FOR CONTROLLING AN EXPANDABLE MIXTURE

(75) Inventors: Yusuke Kato, Toyokawa (JP); Toshihiko Zenpo, Toyokawa (JP); Norihiro Asano, Toyokawa (JP); Kazuyuki Nishikawa, Toyokawa (JP)

(73) Assignee: Sintokogio, Ltd., Aichi (JP)

( * ) Notice: Subject to any disclaimer, the term of this patent is extended or adjusted under 35 U.S.C. 154(b) by 407 days.

(21) Appl. No.: 11/921,956

(22) PCT Filed: Jun. 9, 2006

(86) PCT No.: PCT/JP2006/311620

§ 371 (c)(1),
(2), (4) Date: Dec. 11, 2007

(87) PCT Pub. No.: WO2006/134841

PCT Pub. Date: Dec. 21, 2006

(65) Prior Publication Data

US 2009/0092171 A1 Apr. 9, 2009

(30) Foreign Application Priority Data

Jun. 15, 2005 (JP) ..... 2005-174520

(51) Int. Cl.
*G01K 11/00* (2006.01)
*G01K 11/06* (2006.01)
*B29C 44/34* (2006.01)

(52) U.S. Cl. ..... 374/141; 374/160; 374/16; 374/55; 425/4 R

(58) Field of Classification Search ..... 374/1, 374/2, 10–104, 139, 160–161, 141; 425/4 R, 425/140, 542, 562, 817 R, 449, 436 R, 444, 425/169, 812, 546, 556, 450.1, 451, 451.2
See application file for complete search history.

(56) References Cited

U.S. PATENT DOCUMENTS

| | | | | |
|---|---|---|---|---|
| 3,590,906 | A | 7/1971 | Bayliss et al. | |
| 5,028,367 | A * | 7/1991 | Wei et al. | 264/656 |
| 7,500,840 | B2 * | 3/2009 | Zenpo et al. | 425/4 R |
| 2002/0096016 | A1 * | 7/2002 | LaSalle et al. | 75/246 |
| 2009/0071361 | A1 * | 3/2009 | Hetz et al. | 102/306 |

FOREIGN PATENT DOCUMENTS

| | | |
|---|---|---|
| GB | 1 402 536 A | 8/1975 |
| GB | 2 039 239 A | 8/1980 |
| JP | 55-54241 | 4/1980 |
| JP | 55 54241 A | 4/1980 |
| JP | 56-4342 | 1/1981 |
| JP | 10-225745 | 8/1998 |
| JP | 2000-190049 | 7/2000 |

* cited by examiner

*Primary Examiner*—Gail Verbitsky
(74) *Attorney, Agent, or Firm*—Finnegan, Henderson, Farabow, Garrett & Dunner, L.L.P.

(57) ABSTRACT

A method is disclosed that monitors and controls the condition of an expandable mixture before injecting it in a mold and that maintains the conditions for filling so as to make a casting mold having a uniform strength.

The method comprises (a) a step of measuring the temperature of the expandable mixture, (b) a step of determining each reference value of the one or more characteristic parameters that show a characteristic property of the expandable mixture based on the measured temperature and the predetermined relationship between a characteristic property of an expandable mixture and its temperature, (c) a step of measuring the one or more characteristic parameters that show the condition of the mixing of the expandable mixture, (d) a step of determining whether each characteristic parameter is within the corresponding reference value, and (e) a step of determining whether the expandable mixture has been made under the normal condition or if it needs to be adjusted.

10 Claims, 4 Drawing Sheets

METHOD FOR CONTROLLING AN EXPANDABLE MIXTURE

TECHNICAL FIELD

The present invention relates to a method for controlling an expandable mixture. More particularly, it relates to a method for controlling the expandable mixture so as to make it in a predefined normal condition when a casting mold, e.g., a main mold or a core, is made by injecting the expandable mixture into a heated cavity of a mold, wherein the expandable mixture is made by mixing a particulate aggregate, a water-dispersed binder, and water, and then agitating them.

BACKGROUND OF THE INVENTION

Recently, a method for making a casting mold that uses a water-dispersed binder as a binder of particulate aggregate and hardening it by heating it and evaporating the moisture has been proposed, because the collapsibility of one made by this method is good.

A conventional casting mold molding machine that makes such a casting mold as the above comprises, for example, an injection means for injecting fluid sand into a mold that can go up and down, wherein the injection means has a cylindrical hollow that vertically extends, a plunger that is located in it so that it can move up and down, and a gate that opens and shuts the opening located at the bottom of the cylindrical hollow, wherein an opening is provided in the middle of the cylindrical hollow and a mixer is installed on the opening so as to feed the fluid sand to the cylindrical hollow (see Japanese Patent Laid-open Publication No. S55-54241).

Further, the conventional casting mold molding machine can vary the quantity of the fluid sand fed to the cylinder hollow so as to vary the quantity to be injected in the mold by making a gate at the middle of the cylinder hollow, or by changing the location of the cylinder hollow, the opening at its bottom, or the plunger.

SUMMARY OF THE INVENTION

However, the conventional casting mold molding machine needs to have water added to the mixture and to have the mixture mixed, because the fluidity of the expandable mixture, which is a material for a casting mold having a water-dispersed binder, decreases and a sufficient amount of the mixture cannot be filled in the cavity of a mold, when it does not have enough water. Further, when the viscosity of the expandable mixture is too high, not enough of the mixture can be filled in the cavity of a mold, and so the mixture must be again mixed.

So, the purpose of this invention is to provide a method for controlling an expandable mixture that can provide a way to monitor and control the condition of the expandable mixture before it is injected in a mold, and that can increase the efficiency of the filling and uniformity of the strength of a casting mold by maintaining the condition for filling when the mixture is molded.

The method for controlling an expandable mixture of this invention controls the mixture so as to make it in a predefined normal condition when a casting mold is made by injecting the mixture in a heated cavity of a mold, wherein the expandable mixture is made by mixing particulate aggregate, a water-dispersed binder, and water. The method comprises (a) a step of measuring the temperature of the expandable mixture, (b) a step of determining each reference value of the one or more characteristic parameters that show a characteristic property of the expandable mixture based on the measured temperature and the predetermined relationship between a characteristic property of an expandable mixture and its temperature, (c) a step of measuring the one or more characteristic parameters that show the condition of the mixing of the expandable mixture, (d) a step of determining whether each characteristic parameter is within the corresponding reference value, and (e) a step of determining whether the expandable mixture has been made under the normal condition or if the condition needs to be adjusted.

Further, the method for controlling an expandable mixture of the invention controls the mixture so as to make it in a predefined normal condition when a casting mold is made by injecting the mixture into a heated cavity of a mold, wherein the expandable mixture is made by mixing particulate aggregate, a water-dispersed binder, and water, as follows: (a) a step of measuring the temperature of the expandable mixture, (b) a step of determining the reference values of the moisture content and the viscosity that show a characteristic property of the expandable mixture based on the measured temperature and the predetermined relationship between the characteristic property of the expandable mixture and its temperature, (c) a step of measuring the moisture content that shows the condition of the mixing of the expandable mixture, (d) a step of determining whether the moisture content that is measured is within the reference value, (e) a step of measuring the viscosity of the expandable mixture that shows the condition in which it is mixed when the moisture content is within its reference value, (f) a step of determining whether the measured viscosity is within the reference value, and (g) a step of determining if the expandable mixture is in a normal condition.

By this invention, the strength of a casting mold is made uniform by maintaining the condition for filling when the casting mold is made.

BRIEF DESCRIPTIONS OF THE DRAWINGS

DETAILED DESCRIPTION OF THE PREFERRED EMBODIMENT

Figure 1:
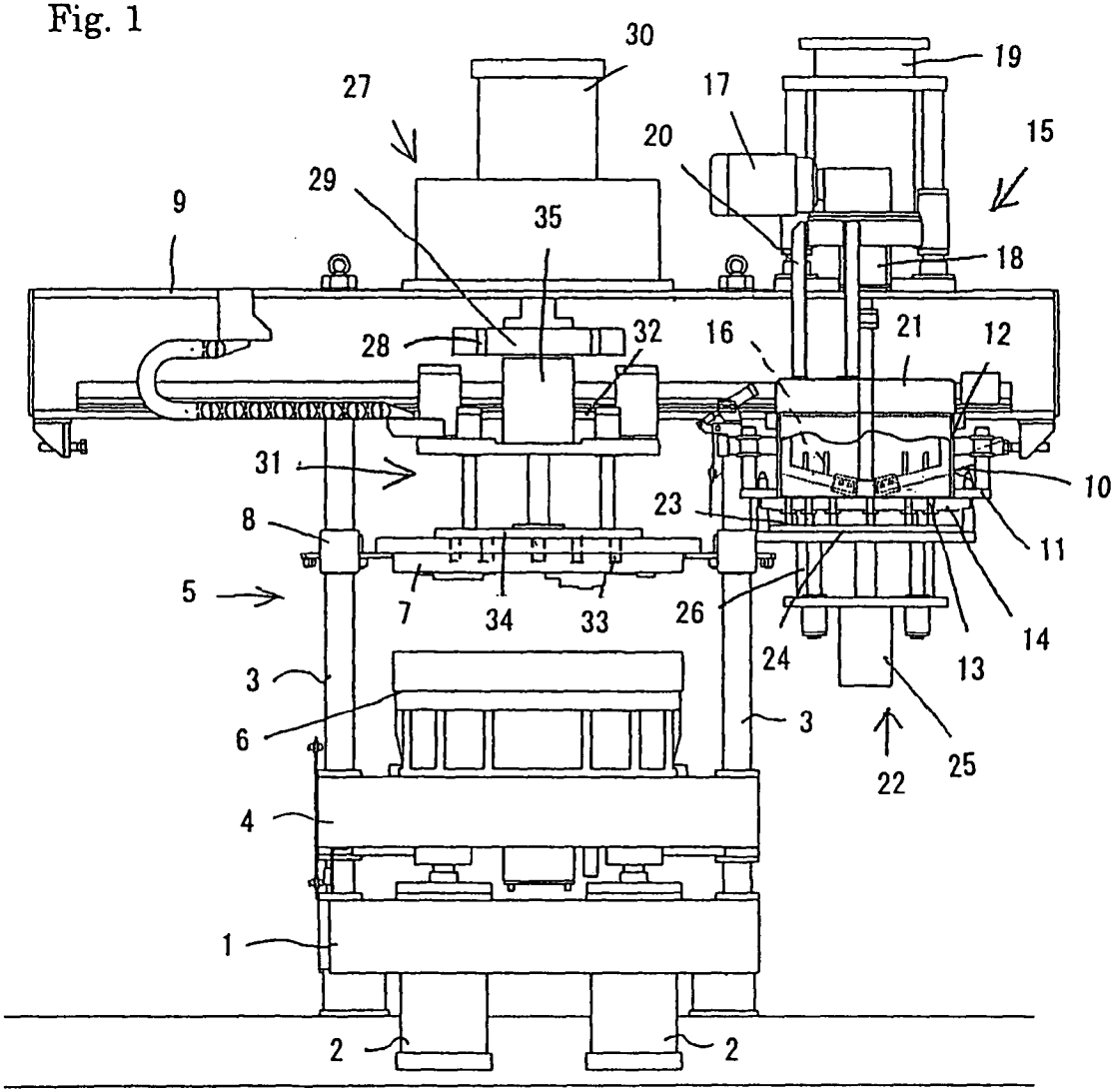
FIG. 1 is a front view of a casting mold molding machine of this invention with a fragmentary sectional view.

Now, we discuss the method for controlling an expandable mixture of this invention based on FIGS. 1-4. The casting mold molding machine that is used for this invention has two cylinders 2, 2 that push their arms upward through a machine table 1. Further, guiding rods 3, 3 are installed on the four corners of the machine table 1. The piston rods of the two cylinders 2, 2 support a lifting frame 4 at its lower surface, wherein the lifting frame 4 can move up and down and its four corners are slidably provided through the four guiding rods 3, 3. The lower mold 6 of a horizontal split-type mold 5 is set on the upper surface of the lifting frame 4. The upper mold 7 of the horizontal split-type mold 5 is located just above the lower mold 6 and supported by four supporting pieces of equipment 8, 8 that are installed on the upper side of the lower mold 6 through the guiding rods 3, 3.

The guiding rods 3, 3 support a ceiling-frame 9, which extends horizontally. A mixture-storage means 10 that also acts as a vessel for stirring and as a cylinder for injections is provided on the lower-right side of the ceiling-frame 9 so that the No. 1 dolly 11 can move it to the left side of the ceiling-frame 9. The mixture-storage means 10 comprises a hollow cube 12 that has a hollow that vertically runs through it, and a bottom plate 14 that is fixed at the bottom of the hollow cube 12 to close it and that has openings for injections 13, 13 through which the mixture is injected. The bottom plate 14 has a water-cooled structure on its upper portion and a heat shielded structure on its bottom.

A mechanism of agitating blades 15 is provided on the upper-right side of the ceiling-frame 9. The mechanism mixes particulate aggregate, a water-dispersed binder that is soluble at ambient temperatures, and water, which are all put in the mixture-storage means. Then the agitating blades agitate the mixture and cause it to foam. The particulate aggregate may be silica sand, for example. The water-dispersed binder that is used for the binder of the particulate aggregate may be polyvinyl alcohol. The mechanism of the agitating blades 15 has agitating blades 16 that are connected to the output shaft of a motor 17 through a transmission gear 18. The motor 17 is set on a support 20 that moves up and down with the expansion and contraction of a cylinder 19. The support 20 has a cover 21 that covers the opening at the upper end of the mixture-storage means 10. The agitating blades 16 and the cover 21 move up and down with the expansion and contraction of the cylinder 19.

A plug means 22 is furnished on the ceiling-frame 9 just under the mechanism of the agitating blades 15. The plug means 22 plugs the openings for injections 13, 13 of the mixture-storage means 10. The plug means 22 has plugs 23, 23 that can be inserted in the openings for injections 13, 13 and are fixed on a supporting plate 24, which is in turn fixed on the upper end of a cylinder 25 that extends upward. The plugs 23, 23 move up and down with the expansion and contraction of a cylinder 25. The cylinder 25 is fixed on the ceiling-frame 9 by supports 26, 26. The openings for injections 13, 13 may be cleaned by inserting a plurality of plugs 23, 23 into them.

A push-out-mechanism 27 is provided on the ceiling-frame 9 just above the horizontal split-type mold 5. The push-out-mechanism 27 pushes the mixture in the mixture-storage means 10 to inject it through the openings for injections 13, 13. The push-out-mechanism 27 comprises a piston 29 that has a plurality of exhaust openings and moves up and down with the expansion and contraction of a cylinder 30 that is installed so as to extend downward.

A casting mold push-out-mechanism 31 is furnished on the lower left side of the ceiling-frame 9 so that it can be moved rightward by No. 2 dolly 32. The casting mold push-out-mechanism 31 pushes a casting mold of the upper mold 7. The casting mold push-out-mechanism 31 comprises a push plate 34 that is fixed on the lower end of the cylinder 35 that extends downward. The push plate 34 has a plurality of casting mold push-out-pins 33. The casting mold push-out-pins 33, 33 move up and down with the expansion and contraction of the cylinder 35.

Since it is important to control an expandable mixture so as to make a casting mold of a predefined quality, this invention monitors and controls the condition of the expandable mixture before injecting it into the mold. In this invention a casting mold is made by injecting the expandable mixture into the cavity of a heated mold using the casting mold molding machine.

Namely, this invention measures the temperature of an expandable mixture, and then determines each reference value of the one or more characteristic parameters that show the characteristic property of the expandable mixture based on the measured temperature according to the predetermined characteristic property of the expandable mixture (which depends on its moisture content, its viscosity, the type and the particle size of the sand, and the type and the quantity of the binder). The characteristic parameter may be its moisture content or its viscosity.

Then, the one or more characteristic parameters that show the condition of the mixing of the expandable mixture is measured, and then by the invention it is determined whether each determined parameter (i.e., the value of its moisture content or its viscosity) is within the reference values (e.g., within an upper threshold and a minimum threshold of the reference values).

After that, it is determined whether the expandable mixture is in a normal condition or if it should be adjusted. Depending on the determination, if the expandable mixture is in a normal condition, i.e., each of the measured parameters is judged to be within the corresponding reference value, the expandable mixture will be injected into the cavity of the heated mold and a casting mold will be made. In contrast, if each of the measured parameters of the expandable mixture is judged not to be within the corresponding reference value then, after adjusting the components related to the viscosity and/or the moisture content, the condition of the expandable mixture will again be monitored.

Figure 3:
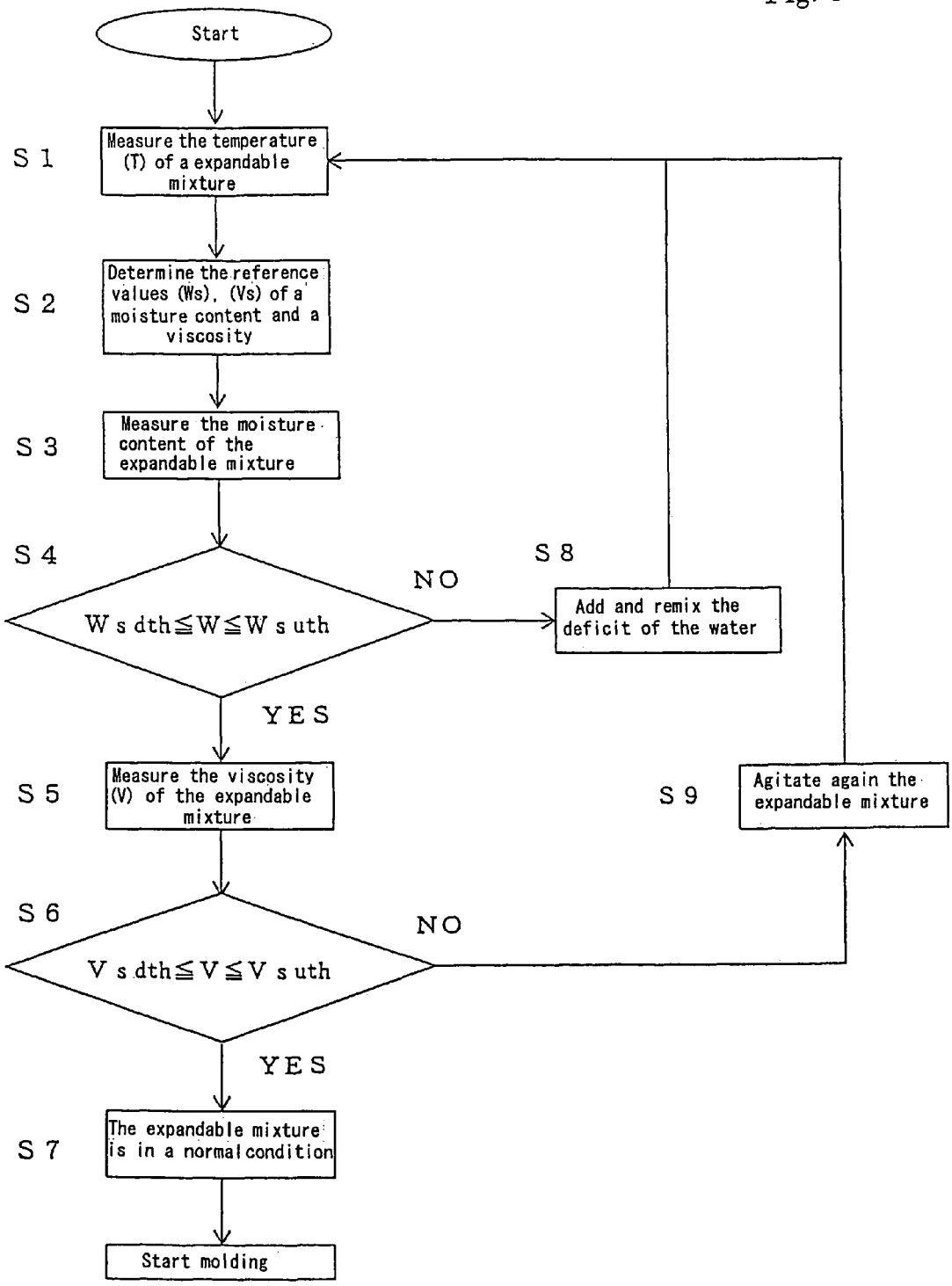
FIG. 3 is a flowchart of one embodiment of this invention.
Figure 4:
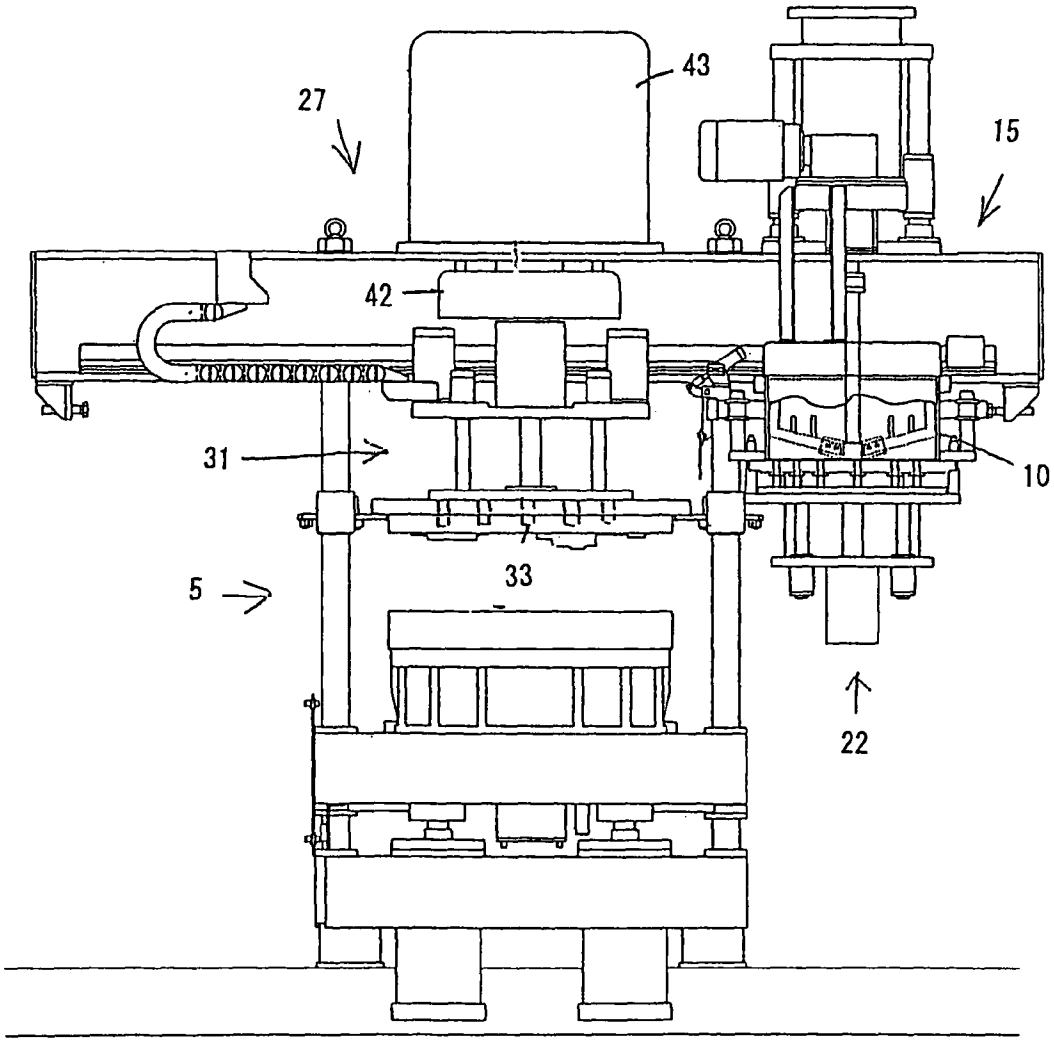
FIG. 4 is a front view of the casting mold molding machine of this invention with a fragmentary sectional view.

Now, we discuss the procedures for controlling the method in one embodiment of this invention, by referring to FIG. 3.

(a) As shown in FIG. 3, the temperature (T) of an expandable mixture is measured by a sensing means (step S1).

The expandable mixture is composed of particulate aggregate, a water-dispersed binder, and water, and they are mixed, agitated, and foamed by a driving mechanism of agitating blades in a mixture storage means. The particulate aggregate may be silica sand, alumina sand, olivine sand, chromite sand, zircon sand, mullite sand, or various kinds of synthetic aggregate. The water-dispersed binder being used for the binder of the particulate aggregate may be a polyvinyl alcohol or its derivatives, e.g., polyvinyl alcohol or its derivatives of a degree of saponification of 80-95 mol %, and/or $\alpha$-starch, dextrin, or its derivatives, or saponin, or sugars. The water-dispersed binder is mixed into the particulate aggregate, for example, by 0.3-10 wt % of the weight of the aggregate. The water can be any water other than alkaline water. The content of the water may be, for example, 2-10% of the water-dispersed binder. The temperature sensing means may include, but it is not limited to, a contact-type or noncontact-type temperature sensing means, as, for example, a thermocouple-type temperature sensor as a contact-type or a temperature sensor utilizing a laser, infrared rays (thermograph), or ultrasound, as a noncontact-type.

(b) Then, the reference values (Ws), (Vs) for the moisture content and the viscosity of the expandable mixture are determined based on the measured temperature and the predetermined relationship between a characteristic property of an expandable mixture and its temperature (step S2). These values show a characteristic property of the expandable mixture and affect the quality of moldings, particularly in this embodiment.

The fluidity and fraction of bubbles of an expandable mixture vary based on variations of its temperature, moisture content, or viscosity. Accordingly, the quality of a casting mold, such as the difficulty of filling the expandable mixture, and the strength of a casting mold, also varies depending on them. Therefore, the correlations between the temperature, moisture content, viscosity, etc., are predetermined as a characteristic property of the mixture by experiments.

(c) After that, the moisture content (V), which shows the condition of the mixing of the expandable mixture, is measured by a moisture content measuring means (step S3).

The moisture content measuring means may include, but is not limited to, a moisture analyzer such as one that uses a method for measuring the electrical resistance or a method utilizing microwaves, or a moisture analyzer that heats the sampled expandable mixture and evaporates its moisture and then determines the moisture content by measuring its decreased weight.

(d) Then, whether the moisture content (W) is within the reference value (Ws) is determined.

Namely, whether the moisture content (W) of the expandable mixture is within the value between the upper threshold (Wsuth) and the minimum threshold (Wsdth), which value denotes that it is within the reference value (Ws), is determined. The upper threshold (Wsuth) and the minimum threshold (Wsdth) may be determined beforehand by some experiments.

(e) After that, the viscosity (V), which shows the condition of the mixing of the expandable mixture, is measured by the viscosity measuring means, to see if the moisture content (W) is within the reference value (Ws) (step S5).

The viscosity measuring means may include, but it is not limited to, viscosity measuring means such as that utilizing a method inserting a probe, rotating a probe, or inserting and rotating a probe, or such means that measures an apparent viscosity. For example, a viscosity detector utilizing the method for inserting a probe measures the viscosity in a relative manner, i.e., a spherical- or columnar-shaped part is built on the top of a rod-type probe (this part may be made with the rod or made separately), and the top of the probe is inserted into an expandable mixture, and then the load (the resistance) of the insertion is determined as the viscosity. A viscosity detector utilizing the method of rotating a probe measures the viscosity in a relative manner, i.e., a spherical- or columnar-shaped part is built on the top of a rod-type probe (the part may be made with the rod or made separately), and the top of the probe is spun and inserted into an expandable mixture, and then the load (the resistance and the torque) of the probe is determined to be the viscosity. A viscosity detector utilizing the method of inserting and rotating a probe measures the viscosity in a relative manner, i.e., a disk- or fan-shaped part is built on the top of a rod-type probe (the part may be made with the rod or made separately), and the top of the probe is inserted into an expandable mixture and is spun, and then the load (the torque) of the probe is determined as the viscosity. Further, a viscosity detector that measures an apparent viscosity measures the viscosity in a relative manner, i.e., an expandable mixture is fed into a cylinder that has a given bore diameter, a predetermined pressure is applied to it, and then the velocity of it when coming out of the cylinder is measured to determine the viscosity. Since the expandable mixture is a non-Newtonian liquid, the viscosity detector utilizing a method inserting a probe, rotating a probe, or inserting and rotating a probe, should be more preferable than one that measures an apparent viscosity.

(f) After that, whether the measured viscosity (V) is within the reference value (Vs) of the viscosity is determined (step S6).

Namely, whether the viscosity of the expandable mixture is within the value between the upper threshold and the minimum threshold, which value denotes that it is within the reference value of the viscosity, is determined.

(g) Then, if the viscosity (V) is within the reference value (Vs) of the viscosity, the expandable mixture is determined to be in a normal condition (step S7), and a molding process is started.

(h) If the moisture content (W) that is measured in step S4 is not within the reference value (Ws) (between the thresholds Wsdth and Wsuth) of the moisture content, the water that is lacking is added and the expandable mixture is remixed and agitated (step S8).

(i) If the viscosity (V) that is measured in step S6 is not within the reference value (Vs) (between the thresholds Vsdth and Vsuth), the expandable mixture is agitated and mixed again so as to get a predetermined viscosity.

In this invention, the temperature, the viscosity, and the moisture content of the expandable mixture are respectively measured by the temperature sensor, the viscosity detector, and the moisture analyzer, which are all installed inside or outside of the mixture storage means.

In this invention, the temperature, etc., may also be measured in a batch process by sampling the expandable mixture from the mixture storage means, or in a continuous process by installing the measuring equipment in the mixture storage means.

In this invention, since the figures for the viscosity and the moisture content vary based on the variation of the type of the particulate aggregate and the water-dispersed binder, it is difficult to specify the most appropriate values. However, the reference value of the viscosity should be 0.5-5 Pa·s and the reference value of the moisture content should be 2-10 wt %, if the temperature of the sand is 0-40° C., for example.

Now, we discuss an example of this invention. But the invention is not restricted by this example.

Example

This example used silica sand as the particulate aggregate, and polyvinyl alcohol (made by Japan Vam & Poval Co. Ltd.) and a starch (dextrin NSD-L made by Nissi & Co., Ltd.) as water-dispersed binders. 100 parts by weight of silica sand (Flattery sand), 0.2 part by weight of a polyvinyl alcohol, 0.8 part by weight of starch, 0.2 part by weight of a citric acid, and 5 parts by weight of water, were mixed, agitated, and foamed so that the viscosity was 2 Pa·s and the moisture content was 4.5 wt %. The temperature was 20° C.

After the mixture was foamed, the viscosity and the moisture content of it were measured. The viscosity was 0.5-3.5 Pa·s and the moisture content was 2.5-7 wt %. After it was confirmed that these values were within the reference values, a molding process was started. Thus, it was confirmed that this method of controlling an expandable mixture was effective to maintain the efficiency of filling when the mixture was used for molding.

Now, we discuss the function of the casting mold molding machine that molds a casting mold according to this invention. As in FIG. 1, after the openings for injections 13, 13 are plugged by plugs 23, 23 of a plug means 22, then, for example, silica sand as the particulate aggregate, polyvinyl alcohol as a water-dispersed binder, and water, are put in the mixture storage means 10. Then, the opening on its top end is closed by a cover 21.

Then a motor 17 of a mechanism for agitating blades 15 is operated and agitating blades 16 are rotated to mix and agitate the silica sand, the polyvinyl alcohol, and water, and so a foamed expandable mixture is made.

Then, a cylinder 19 pulls its arm in to raise the agitating blades 16 and cover 21. After that, in line with the above procedure, the property of the expandable mixture is confirmed to be in a normal condition by controlling a temperature sensor D1, a viscosity detector D2, and a moisture analyzer D3, and then a cylinder 25 of a plug means 22 pulls its arm in and pulls plugs 23, 23 out from the openings for injections 13, 13 so as to open the openings for injections 13, 13.

After that, the casting mold push-out-mechanism 31 is moved leftward by a No. 2 dolly 32, and the mixture storage means 10 is also moved leftward by a No. 1 dolly 11, which is located just above the heated horizontal split-type mold 5. Then, the cylinder 2 pushes its arm out to raise the lower mold 6 with the lifting frame 4 and to put the upper mold 7 on the lower mold 6 and to put the mixture storage means 10 on the upper mold 7 and to make the lower end of the mixture storage means 10 contact the upper end of the upper mold 7.

Figure 2:
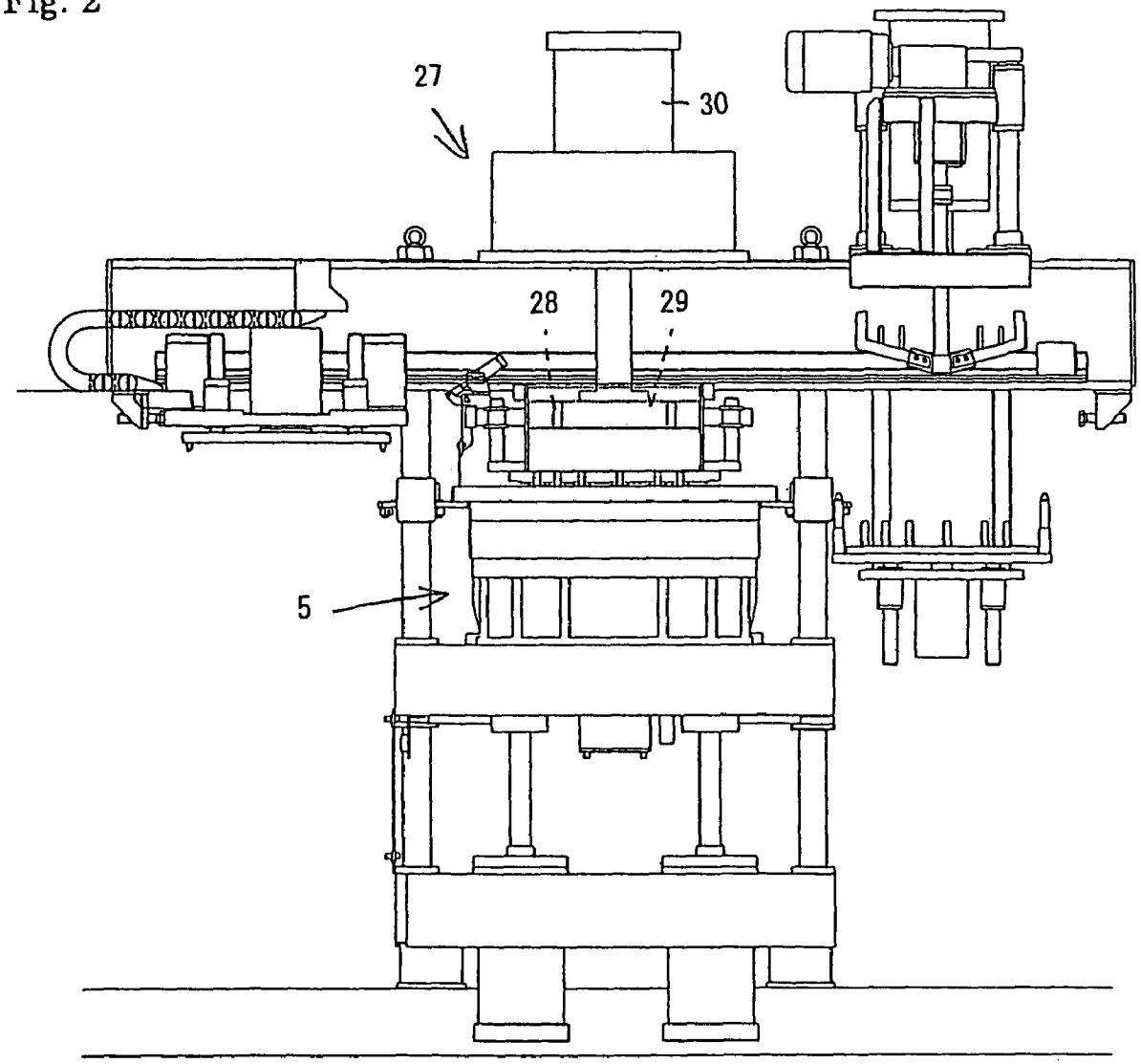
FIG. 2 is an explanatory drawing of the casting mold molding machine of FIG. 1. It shows the situation of injecting an expandable mixture in a mixture storage means into a horizontal split-type mold.

Then, as shown in FIG. 2, the cylinder 30 of the push-out-mechanism 27 pushes its arm to let down the piston 29. After letting the air between the piston 29 and the mixture go out through exhaust ports 28, 28 while the piston is descending, the openings of the upper ends of the exhaust ports 28, 28 are closed by valve means, which are not shown, and then the mixture in the mixture storage means 10 is pressed to be injected in the cavity of the horizontal split-type mold 5. The mixture that has been injected in it is hardened, because the moisture is evaporated by the heat of the horizontal split-type mold 5. After the injection of the mixture into the horizontal split-type mold 5 is completed, the cylinder 30 pulls in its arm to raise the piston 29, and then the casting mold push-out-mechanism 31 is moved rightward by a No. 2 dolly 32, and the mixture storage means 10 is also moved rightward by No. 1 dolly 11 so that the casting mold push-out-mechanism 31 returns to the position just above the horizontal split-type mold 5 and the mixture storage means 10 returns to the position just under the mechanism of the agitating blades 15.

Thereafter, the cylinder 35 of the casting mold push-out-mechanism 31 pushes its arm to insert the casting mold push-out-pins 33, 33 in the upper mold 7. Then the cylinders 2, 2 pull their arms in to let down the lower mold 6 so that the casting mold is separated from the upper mold 7. After that, a casting mold push-out-mechanism, which is not shown, pushes the casting mold up from the lower mold 6. Meanwhile, silica sand, polyvinyl alcohol, and water are put in the mixture storage means 10, which has returned to the position just under the mechanism of the agitating blades 15, as required for the next molding.

In this example, the mixture in the mixture storage means 10 was injected in the horizontal split-type mold 5 by the piston 29 of the push-out-mechanism 27. However, the method for the injection of the mixture is not restricted to this, but, as in FIG. 4, a method wherein the mixture is injected by compressed air may achieve the same effect. Namely, instead of the piston 29, a cover 42 that air-tightly closes the opening of the upper end of the mixture storage means 10 and communicates with a source of compressed air may be installed at the lower end of the piston rod of a cylinder 43 in the push-out-mechanism 27. When the mixture is injected into the horizontal split-type mold 5, compressed air may be supplied to the upper surface of the mixture in the mixture storage means 10. In this case, the agitation mechanism and the injection mechanism of compressed air may be combined.

What is claimed:

1. A method for controlling an expandable mixture so as to make it in a predefined normal condition when a casting mold is made by injecting the expandable mixture in a heated cavity of a mold, wherein the expandable mixture is made by mixing particulate aggregate, a water-dispersed binder, and water, wherein the method comprises (a) a step of measuring the temperature of the expandable mixture, (b) a step of determining each reference value of the one or more characteristic parameters that show a characteristic property of the expandable mixture based on the measured temperature and the predetermined relationship between a characteristic property of an expandable mixture and its temperature, (c) a step of measuring the one or more characteristic parameters that show the condition of the mixing of the expandable mixture, (d) a step of determining whether each characteristic parameter is within the corresponding reference value, and (e) a step of determining whether the expandable mixture has been made under the normal condition or if the condition needs to be adjusted.

2. The method for controlling an expandable mixture of claim 1, wherein the characteristic parameters are the moisture content and the viscosity of the expandable mixture.

3. A method for controlling an expandable mixture so as to make it in a predefined normal condition when a casting mold is made by injecting the expandable mixture in a heated cavity of a mold, wherein the expandable mixture is made by mixing particulate aggregate, a water-dispersed binder, and water, wherein the method comprises (a) a step of measuring the temperature of the expandable mixture, (b) a step of determining reference values of the moisture content and the viscosity that show a characteristic property of the expandable mixture based on the measured temperature and the predetermined relationship between a characteristic property of an expandable mixture and its temperature, (c) a step of measuring the moisture content of the expandable mixture that shows the condition of the mixing of it, (d) a step of determining whether the measured moisture content is within the reference value of it, (e) a step of measuring the viscosity of the expandable mixture that shows the condition of the mixing of it, if the measured moisture content is within the reference value of it, (f) a step of determining whether the measured viscosity is within the reference value of it, and (g) a step of determining if the expandable mixture is in a normal condition and if the measured viscosity is within the reference value of it.

4. The method for controlling an expandable mixture of claim 3, wherein it further comprises a step of adding any lacking water and remixing the expandable mixture, if the measured moisture content is not within the reference value of it.

5. The method for controlling an expandable mixture of claims 3 or 4, wherein it further comprises a step of remixing the expandable mixture if the measured viscosity is not within the reference value of it.

6. The method for controlling an expandable mixture of claim 5, wherein the temperature of the expandable mixture is measured by either a contact-type temperature sensing means or a noncontact-type temperature sensing means.

7. The method for controlling an expandable mixture of claim 5, wherein the moisture content of the expandable mixture is measured by either a method measuring an electrical resistance of it or a method utilizing microwaves.

8. The method for controlling an expandable mixture of claim 5, wherein the viscosity of the expandable mixture is measured by viscosity measuring means utilizing a method of inserting a probe, viscosity measuring means utilizing a method of rotating a probe, or viscosity measuring means utilizing a method of inserting and rotating a probe.

9. The method for controlling an expandable mixture of claim 5, wherein the moisture content and the viscosity of the expandable mixture are measured in a batch process by sampling the expandable mixture from a mixture storage means for the expandable mixture.

10. The method for controlling an expandable mixture of claim 5, wherein the temperature, the moisture content, and the viscosity of the expandable mixture are measured in a continuous process by installing the measuring means in a mixture storage means for the expandable mixture.

* * * * *